US010252404B2

(12) United States Patent
Hauser

(10) Patent No.: US 10,252,404 B2
(45) Date of Patent: Apr. 9, 2019

(54) APPARATUS AND METHOD FOR GRASPING A SCREW BENEATH THE SCREW HEAD WITH JAWS AND FOR RELEASING SAME

(71) Applicant: David Hauser, Merrick, NY (US)

(72) Inventor: David Hauser, Merrick, NY (US)

( * ) Notice: Subject to any disclaimer, the term of this patent is extended or adjusted under 35 U.S.C. 154(b) by 110 days.

(21) Appl. No.: 15/361,580

(22) Filed: Nov. 28, 2016

(65) Prior Publication Data

US 2018/0147704 A1 May 31, 2018

(51) Int. Cl.
*B25B 23/10* (2006.01)

(52) U.S. Cl.
CPC ..... *B25B 23/101* (2013.01)

(58) Field of Classification Search
CPC .. B25B 23/105; B25B 23/0007; B25B 23/101
USPC ..... 81/128; 279/137
See application file for complete search history.

(56) References Cited

U.S. PATENT DOCUMENTS 1,578,364 A * 3/1926 Recen ..... B25B 5/06 269/233
1,862,856 A * 6/1932 Johnson ..... B23B 31/1253 279/137
2,762,409 A 9/1956 Brasen
2,884,826 A * 5/1959 Bruhu ..... B25B 13/44 81/128
3,782,741 A * 1/1974 Laurenti ..... B23B 31/1238 279/137
3,965,950 A * 6/1976 MacDonald ..... B25B 23/10 81/455
4,862,774 A 9/1989 Else
5,355,752 A 10/1994 Keenan et al.
5,881,613 A 3/1999 Han
5,996,446 A * 12/1999 Lee ..... B25B 13/44 279/114
6,073,522 A * 6/2000 Carnesi ..... B25B 13/44 279/114
6,857,343 B1 2/2005 Easterbrooks et al.
6,925,909 B2 8/2005 Crosby et al.
7,779,734 B2 8/2010 Nichols, Jr.
2012/0174938 A1 7/2012 Hill

OTHER PUBLICATIONS

"What is the best technique for using a drill to insert screws", Home Improvement, http://diy.stackexchange.com/questions/7524/what-is-the-best-technique-for-using-a-drill-to-insert-screws, Jul. 8, 2011.

* cited by examiner

*Primary Examiner* — Hadi Shakeri
(74) *Attorney, Agent, or Firm* — Robert J. Hess; Hess Patent Law Firm

(57) ABSTRACT

A dual chuck device with a shaft grasping assembly and a screw stem grasping assembly each with respective jaws, driving mechanism and sleeve. Upon turning a respective sleeve in one direction or the reverse direction, the respective drive mechanism moves the jaws toward or away from a grasping position. In the grasping position, the screw stem is grasped. When the sleeve is presses against a working surface being penetrated by a driven screw, the driving mechanism moves the jaws in the reverse direction to move them apart to no longer grasp the screw.

11 Claims, 8 Drawing Sheets

APPARATUS AND METHOD FOR GRASPING A SCREW BENEATH THE SCREW HEAD WITH JAWS AND FOR RELEASING SAME

BACKGROUND OF THE INVENTION

Field of the Invention

The invention relates to engagement and disengagement between a screw head and a screwdriver or drill shaft tip as the screw is driven into a work surface.

Discussion of Related Art

Screwdrivers of various forms are popular among homeowners, carpenters, builders, and almost anyone with a set of tools.

Most screws have similar features. The head of the screw contains a cavity of various shapes into which the tip of a screwdriver enters. The contact between the screwdriver tip and the head via this cavity enable rotation of the screwdriver to translate into rotation of the screw. The tip of the screw pierces a surface such as wood. The threads of the screw enable the screw to grip into the surface.

At a website for Home Improvement Stack Exchange, there is a discussion about techniques that help prevent slippage when driving a screw with a screwdriver. The following is an excerpt regarding five different kinds of screws:

Flat-head/slotted screws come in many sizes. Having a correctly-fitting bit helps a lot. Too narrow or too thin and you'll damage the head. Too wide and you'll damage the work. Too thick and it won't fit. Fingernails, coins, and knives are non-optimal. Make sure your bit is properly aligned in the slot. Keep the drill directly in line with the screw.

Phillip's head screws are actually designed to "cam out". That is, when the screw stops turning easily, the bit is pushed up and out of the screw head. This is to prevent you from over-torquing the screw and damaging the work, screw, or bit. Unlike flat-head are discrete, #2 being the most common. Make sure you have a correct size. Keep the drill directly in line with the screw. Pressure on the drill is necessary to keep the bit in place. When the angle makes it difficult to apply pressure, set the clutch low and don't work too hard. When the clutch slips, turn the clutch up and apply more pressure to finish the work.

Pozidriv looks a lot like Phillip's, but has a subtly different shape that reduces cam-out. With clutches on drivers today, the chances of over-torquing are greatly reduced. Make sure you know if your bits and screws are Phillip's or Pozidriv. (Supadriv is very similar to Pozidrive.)

Torx, internal hex, and external hex are all easy to drive without much pressure and without cam-out. They also continue to work well if they get dirty or are painted over.

Square, aka Robertson, is easier to work with than Phillip's, but not as easy as Torx & hex heads.

Higher quality screws do not break or strip as easily as lower quality. Cheap screws are more likely to break or round out (i.e., strip) the head.

The following excerpt provides some practical advice:

Good-quality fasteners are worth it. Cheap screws are more likely to break or round out the head. If a driver bit slips out and damages the screw head, then you'll have a harder time finishing the work or removing the damaged screw. More torque means more damage if it slips, so be careful if you turn up the clutch. As soon as a screw is damaged happens, if you pull the screw out before it gets worse and replace it, you'll be better off than if you keep driving the bad screw.

An impact drill/driver makes driving screws much easier. The work turns to butter. They're also loud, a bit expensive, and can destroy your work if you're not careful Driving slowly lets you keep control and reduces damage when the bit slips.

Predrilling in metal/pilot holes in wood make it easier on your muscles, reduce screw breakage, reduce wood splitting, and don't reduce strength. I've heard that it may actually increase strength, but I don't know for sure. I pick a drill the size of the screw [stem].

If you're having trouble with just a few screws on something you want to look nice, you can always drill a pilot hole. This way you're just fighting the torque on the threads, rather than the torque required to displace wood around the shank and drive the threads.

Note that there are two kinds of screws, and hence two kinds of drill bits used for predrilling. Traditional screws taper evenly toward the tip, and should use a taper-point bit for their pilot holes . . . . Modern screws . . . have a constant "root diameter" until you get to the tip; pilot drills for those can be straight bits of that diameter or a bit smaller. (If you really want to do it right, you then drill a slightly larger section of pilot hole for the unthreaded portion of the shaft and, of course, countersink for the head.)

Soap can help lubricate screws in to wood, making it easier and reducing screw breakage.

You should set the speed to low, and use steady power. They sell cordless drills that have three essential features for this:

1. A really low speed setting.
2. A clutch. Whenever the screw is all the way in, it stops turning the drill.
3. Light weight; if you can't easily hold it in place, it's not going to work.

The following excerpt pertains to magnetic bit holders.

These can be helpful. They are typically magnetic, so they hold the screw in place. They also have a sliding sheath, so it will hold the screw in place until you have completely driven the screw.

I don't like the magnetic bit holders much, because it's easy to leave the bit in the fastener. The sheaths are nice when accuracy is unimportant, but if you want the screw to be really straight, you have to hold it a different way (or pilot).

After seeing a lot of amateurs that have a different concept of accuracy, I think these are fantastic for teaching the concept of lining the drill head up with the screw. And the magnets are nice when you're wearing gloves and can't pick the screw out of your pouch.

There are two sets of forces required to operate a screwdriver: (i) the rotational force to turn the screwdriver and screw and (ii) the forward directional force to hold the screwdriver tip in the screw head and to push the screw forward into the surface.

This standard process of using a screwdriver, however, comes with a negative side effect. When driving into a dense surface, such as pressure treated wood, the amount of forward force one needs to apply on the screwdriver can be quite high. As a result, it is common for the screwdriver to slip out of the cavity of the screw head, sometimes causing damage to the screw, screw head cavity, screwdriver, surface, wall, and/or user. This is such a well-known and common problem that products exist to remove screws whose head cavity has been stripped or damaged by screwdriver slippage.

When driving many screws into a dense surface, for example, even if using a powered screwdriver, the user must still exert considerable force onto the screw to prevent the screwdriver tip slipping out of the screw head, risking greater damage, physical injury and increased muscle fatigue. Some products attempting to reduce these issues are on the market, yet all such screwdriver products fail in high force applications.

For example, one such product uses a magnetized screwdriver tip. This product is of value only to screws that are attracted to magnets. The strength of the magnetic attraction between the screw and the screwdriver tip is almost always far weaker than the sheer force required to keep the screwdriver tip inside the screw head cavity when screwing into medium or hard surfaces. Hence, screwdriver slippage is not prevented.

Another such product uses springs in various configurations to keep the screwdriver tip connected to the screw head. This only works when the strength of the forward force required to keep the screwdriver tip inside the screw head cavity is less than the strength of the spring. Once again, hard and dense surfaces often require far greater force to keep the screwdriver tip in the screw head cavity than the springs can provide.

Another set of such products use various premolded forms with prongs that squeezes the screw. These premolded forms have some limitations such as the inability to accommodate various size screw heads, various shapes of the screw head, and various diameter screw stems, and the necessity of the devices to have to flex to insert the screw. As such, these devices suffer from the same consequences as the magnetized screwdriver tip.

Creative solutions of all sorts have been proposed to keep the screwdriver tip in the head of the screw. These include using tape, glue, and other adhesives. However, none of these solutions reduce the need for the user to maintain considerable forward force to ensure the screwdriver tip remains in the screw head.

For instance, in U.S. Pat. No. 2,762,409, tips are provided to hold a screw. However, each tip is affixed to a screwdriver and does not enable one to change screwdrivers. Further, the jaws have a more limited width of a screw head to which they can grip. The jaws are attached to long straight metal lengths. One would need to stretch these apart to enable a wide screw head to fit within these jaws.

U.S. Pat. No. 5,881,613, whose contents are incorporated herein by reference, provides in part:

A conventional power screwdriver is commonly used for driving a fastener, such as a screw, into various work surfaces. Such power screwdrivers do not provide a means for automatically stopping the rotation of a spindle which holds a driver bit. To use such a power screwdriver, an operator must know when to stop applying power to the motor with a trigger switch to stop the rotation of the motor. However, when a screw is driven into a delicate material, such as dry walls, a delay in disconnecting power to the motor may damage the work surface or may result in an excessive penetration of the screw into the work surface.

Some power screwdriver is equipped with a clutch mechanism to either transmit or disconnect the rotation force from the driver motor to the spindle. The clutch mechanism includes a fixed clutch connected to the driver motor and a movable clutch, which engages or disengages the fixed clutch in response to the pressure applied to a housing surrounding the driver bit when the housing is pressed against the work surface. During the disengaging operation, the separation of the clutches is usually abrupt and causes early wear of gear teeth. Similarly, when two clutches reengage each other, the gears or teeth of two clutches grind against each other to foster early wear.

There is a need for a device that enables one to insert a screwdriver through the center, holding the screwdriver tip in the screw head cavity with sufficient force so that when the screw drives through the surface of the material it is going into, the force required to go into the surface will not cause slippage. Such device will not strip the screw face cavity and must be able to hold each individual screw during the screw driving operation and then release the screw after it is screwed into the surface so that the device may then hold the next screw for the next screw driving operation.

SUMMARY OF THE INVENTION

One aspect of the invention is a device and method that includes an assembly that retains an engagement of a shaft tip and a screw head as the screw stem penetrates a surface and that releases the engagement in response to a force applied against an end of a retention sleeve by a working surface that has been penetrated by the stem of the screw. After the release, the screw head may continue to be screwed to penetrate the working surface.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
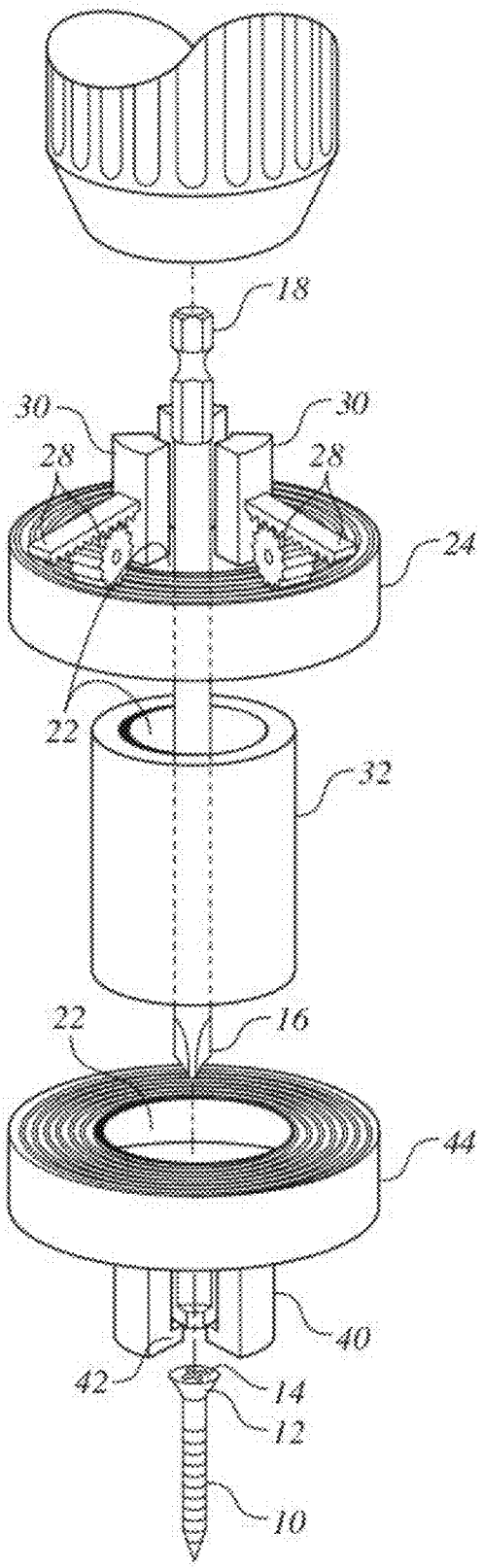
FIG. 1 is an exploded, isometric view of a device having two chucks separated by a cylinder and that allow a shaft to pass through with the shaft tip in position to engage a screw head.

In this example, as depicted in FIGS. 1-6, a screw 10 with an angled head 12, is being screwed into a surface 60 by a dual chuck device 20 in accordance with the invention. Two different approaches are provided to firmly hold the bit or screwdriver shaft 18 and tip 16 in the screw face cavity 14. The tip 16 and screw face cavity 14 are portrayed as a 'Phillips Head' for purposes of the example. It should be understood that the bit or screwdriver and screw tip and cavity can be of a flat, hex-angle, 'Allan Key' or any other design, many of which were mentioned above. The approaches disclosed by this invention combine several different technologies.

Figure 2:
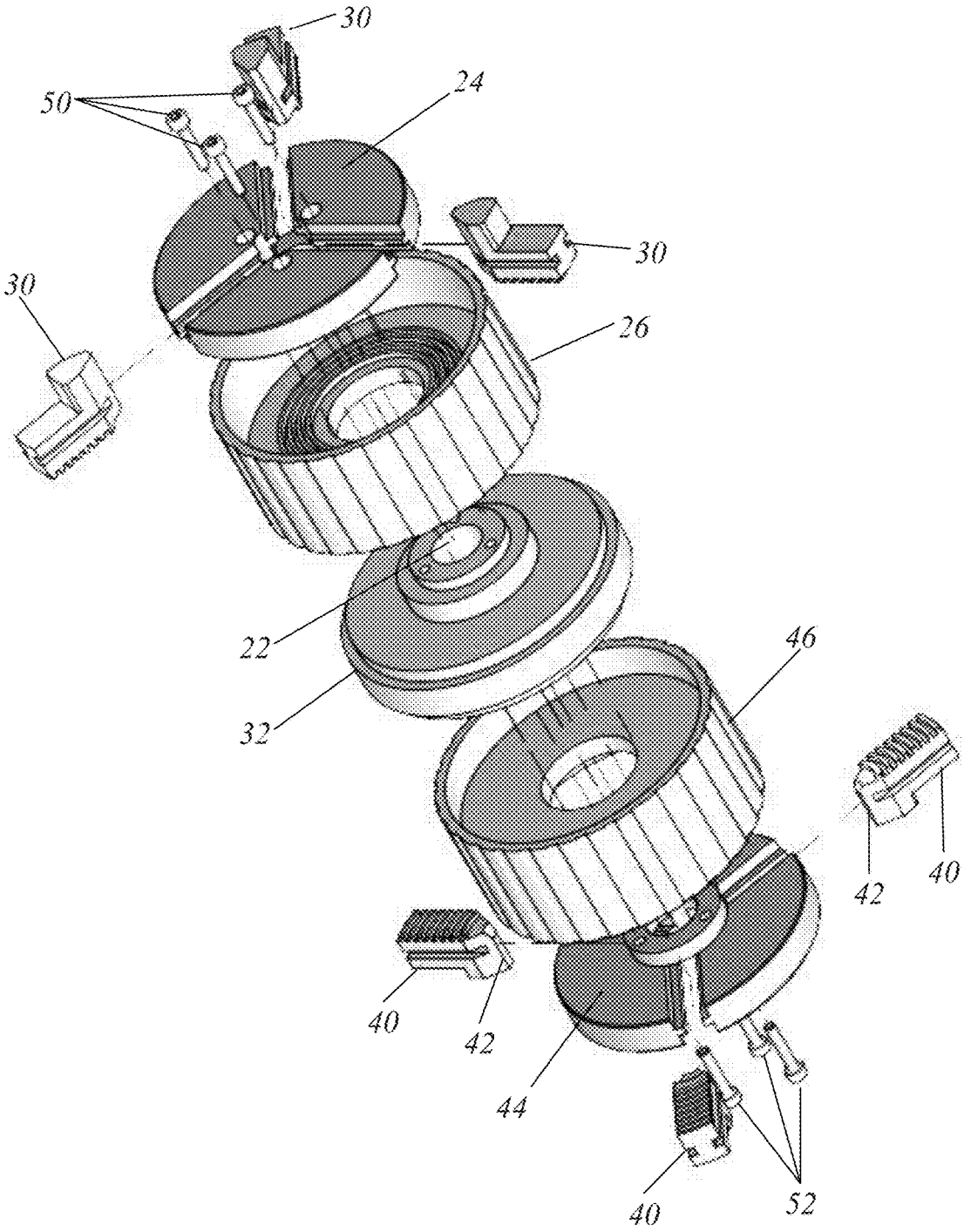
FIG. 2 is a further exploded, isometric view of a device of FIG. 1.
Figure 3:
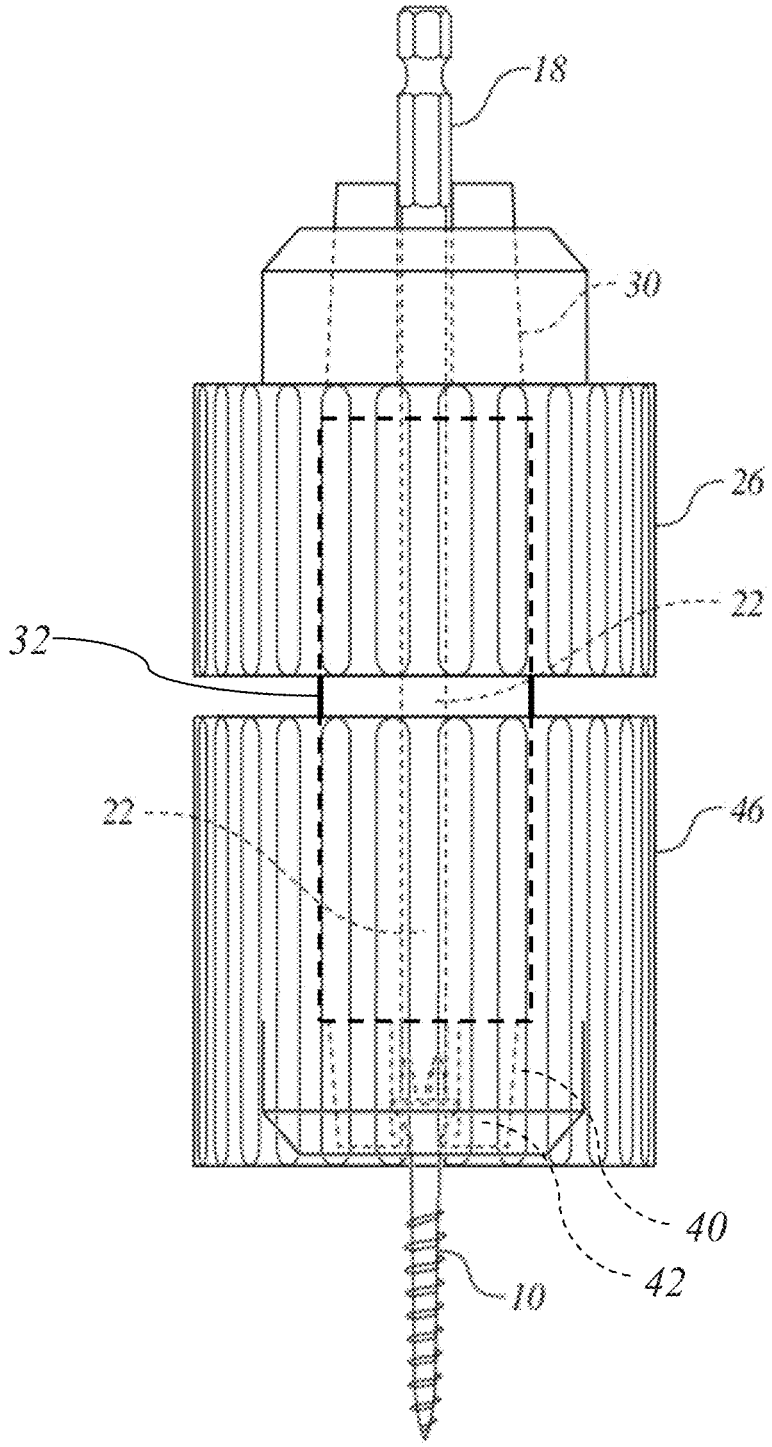
FIG. 3 is a side view of the device of FIG. 1 in an engaged position.
Figure 5:
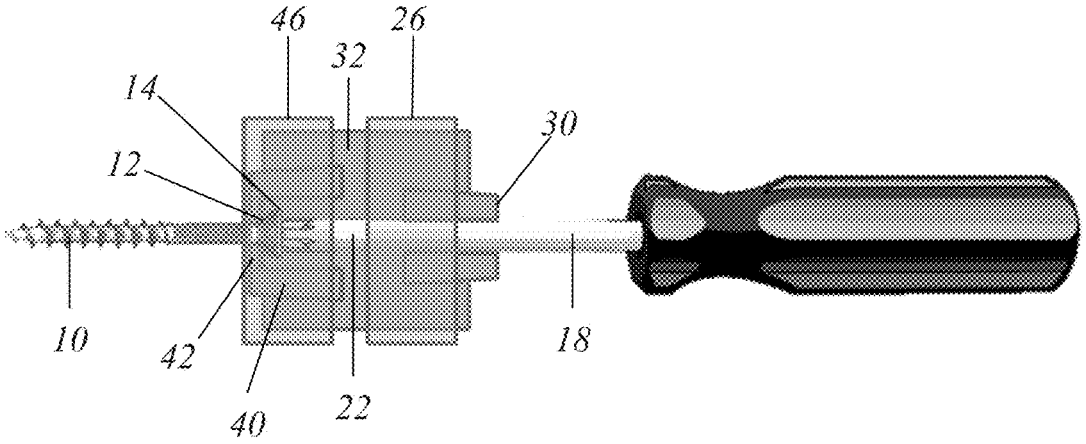
FIG. 5 is a side view of the device of FIG. 1-3, except that a conventional screwdriver shaft replaces the shaft of the device of FIG. 1-3.

FIG. 1 shows the dual chuck device 20 with an inner cavity 22 designed to fit over a drill bit 18. FIGS. 1 and 2 show conventional components of the dual chuck device 20, which include those for a shaft grasping assembly and a screw stem grasping assembly - each has a respective set of jaws 30, 40, a respective contact sleeve 26 and 46, and a respective drive mechanism in the form of a respective notched chuck 24, 44, whose grooved surfaces accommodate sliding of the jaws in a conventional manner with gears or gearing 28 and the like (not shown). Each chuck 24, 44 are configured as a disc with grooved surfaces as depicted in FIG. 1, FIG. 2 or any other embodiment designed for conventional gearing mechanism 28 and the like to move in and out by virtue of the rotation of the chuck 24, 44 or the sleeves 26, 46. Respective ones of the contact sleeves 26, 46 shroud respective ones of the jaws 30, 40 and whose surface have any conventional contour that enhances gripping over that of a smooth surface. (See FIG. 2). There is also a hollow element, such as the cylinder 32 that is arranged to separate the shaft grasping assembly from the screw stem grasping assembly. FIG. 2 shows centrally located fasteners in the form of screws 50, 52 that secure the respective chuck 24, 44 to the center region of the cylinder 32 by passing through central openings in respective chucks 24, 44. On one end of the cavity 22 is the chuck 24 of a conventional drill capable of holding a shaft 18 of a drill bit or a screwdriver by tightening around the shaft 18 of the conventional drill bit (FIG. 6) or of the screwdriver (FIG. 5). As shown in FIGS. 2 and 3, the chuck 24 has a conventional exterior bit contact sleeve 26 that is rotatable in a clockwise direction to cause conventional jaws 30 to move inward or tighten and a counterclockwise direction to cause the conventional jaws 30 to move away or loosen. It should be understood from FIG. 1 and the description above that the gearing 28 and the like is caused to move inward and outward which therefore causes the jaws 30 to so move.

As shown in FIG. 3, the user turns the bit contact sleeve 26, which, as shown in FIG. 1 via conventional internal gears or gearing 28, move several conventional bit contact jaws 30 in the center of the conventional bit chuck 24 that close around the shaft 18 of the conventional drill bit or of a conventional screwdriver. Turning to FIGS. 1 through 3, a clockwise rotation of the bit contact sleeve 26 causes the gearing 28, which gearing 28 can be connected to the notched chuck 24 (FIG. 1) or the sleeve 26 (FIG. 2) to push the bit chuck jaws 30 together, thereby tightening around the bit or shaft 18. In FIG. 1, the gearing 28 is shown as rack and pinion 28; however, one of ordinary skill in the art would recognize that other conventional methods for tightening the bit contact jaws 30 of the bit chuck 24 via the turning of the bit contact sleeve 26 such as notches, tackles, pulley or hydraulic system could be utilized. Collectively, such other methods for (1) tightening/loosening via the turning of the sleeve 26 or chuck 24, and/or (2) moving the gearing 28, may be considered to be a conventional drive mechanism of a conventional shaft grasping assembly.

Given the gearing 28, the tighter one turns the exterior bit contact sleeve 26, the tighter the bit contact jaws 30 hold the drill bit or length/shaft of a screwdriver 18. Turning the bit contact sleeve 26 in a counterclockwise rotation releases the grip of the bit contact jaws 30 from the bit 18. It is noted that it is common for chucks (i.e., for a drill or a screwdriver handle) to have rotating sleeves to control gearing to hold a bit. Such chucks with rotating sleeves are also used in other products such as some flashlights that are controlled by sleeve rotation. There are considerable modifications that can be made to the exterior bit contact sleeve 26, the gearing 28 and the bit contact chuck 24, along with other modifications to enable the connection to the bit or screwdriver length/shaft 18 and still fall within the scope of this invention.

As shown in FIGS. 1, 2 and 3, the chuck 24 typically has one set of the contact jaws 30 that hold the drill bit or screwdriver shaft 18. The bit contact jaws 30 of the notched chuck 24 typically consist of 3 or 4 jaws 30 that come together to grip the drill bit or length/shaft of a screwdriver 18. These jaws 30 have a straight edge that come into contact with the length/shaft or the drill bit 18.

Figure 4A:
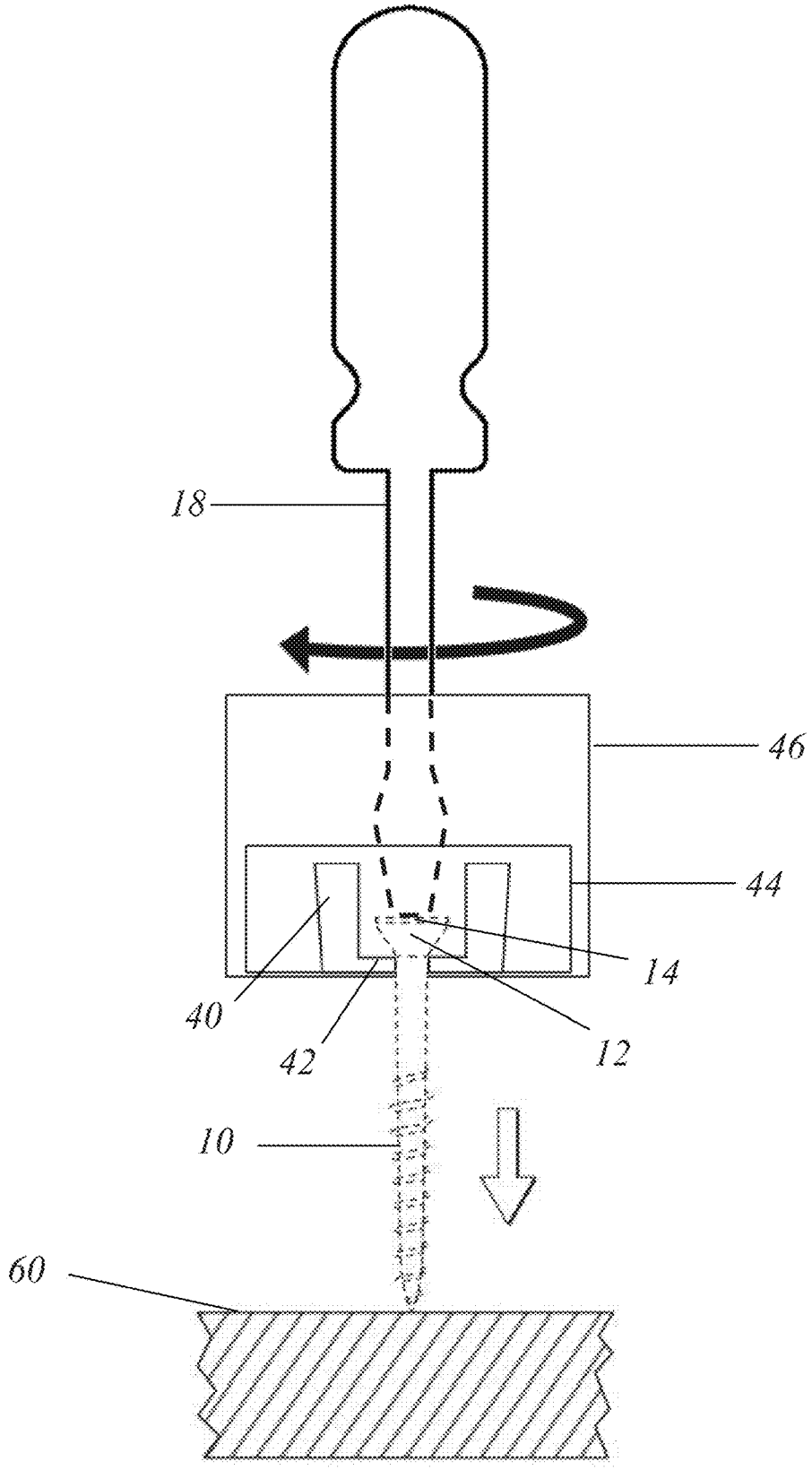
FIGS. 4A, 4B and 4C are progressive views that depict the operation of the device of FIG. 1-3 to penetrate a surface with a screw.
Figure 4B:
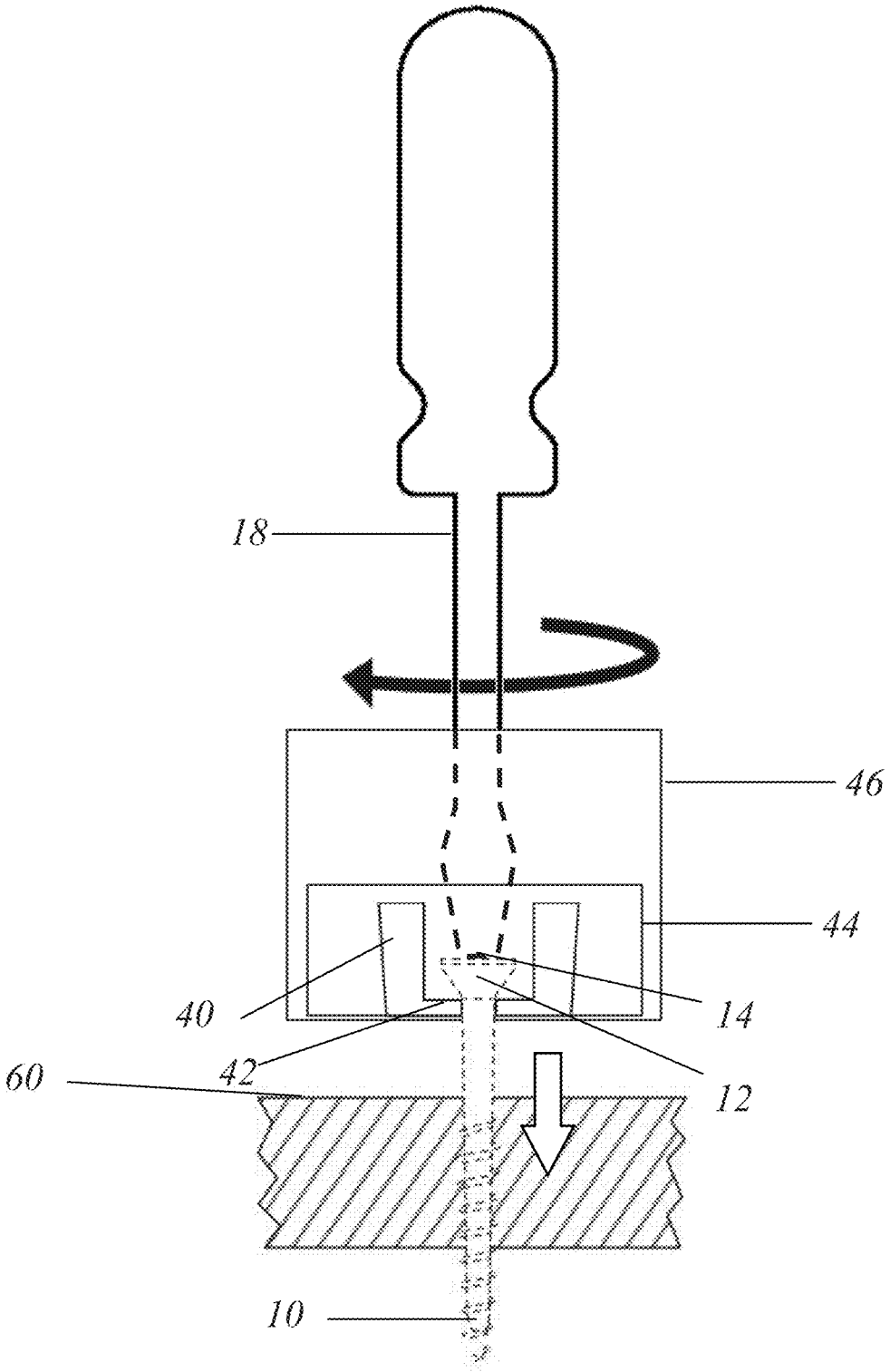
Figure 4C:
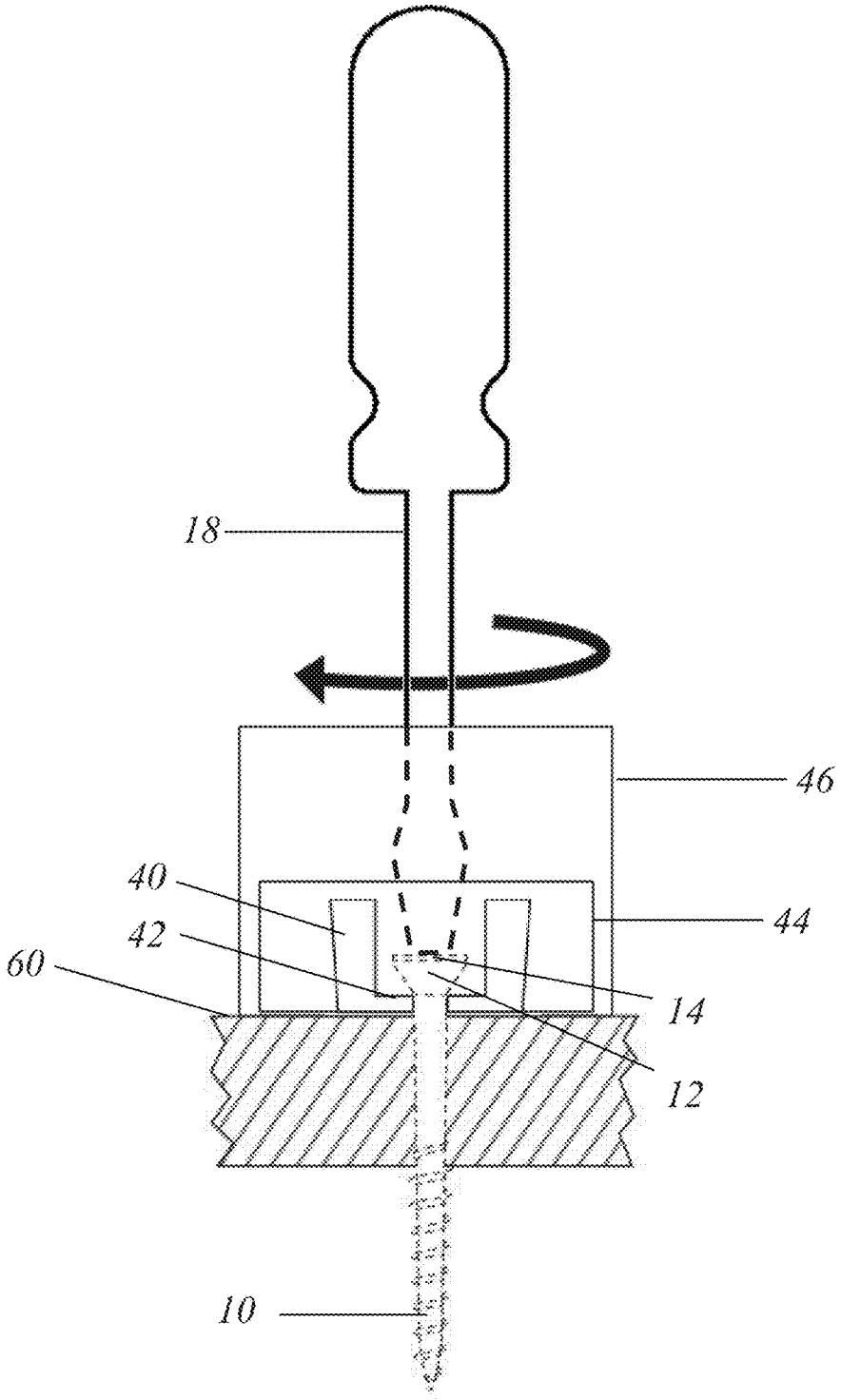
Figure 6:
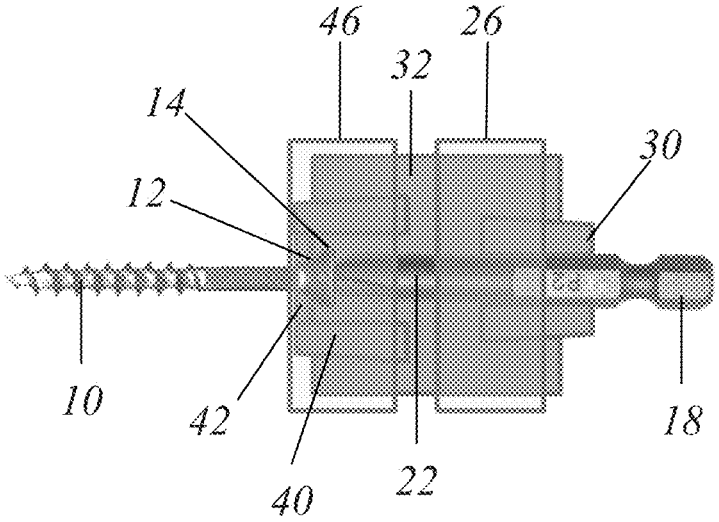
FIG. 6 is a side view of the device of FIG. 1-3, except that a conventional drill bit replaces the shaft in the device of FIG. 1 and FIG. 2.

However, in the present art, there are no such notched chucks with rotating sleeves to hold a screw 10 as part of a screw stem grasping assembly to effect the relative movements shown in the progressive views of FIGS. 4A, 4B and 4C. Moreover, as shown in FIGS. 5 and 6, a device with two chucks at opposite ends facing opposite directions is also novel.

As depicted in FIGS. 1-3, the device 20 has two sets of chucks 24 and 44 with jaws 30 and 40 at each end of the cylindrical device 20, each such chuck 24 and 44 having a respective contact sleeve 26 and 46 - the bit contact jaws 30 controlled by the bit contact sleeve 26 and the screw contact jaws 40 controlled by the screw contact sleeve 46 (preferably in a like manner to that of control by the bit contact sleeve 26 over the bit contact jaws 30). In this way, as shown in FIGS. 1-3, the device 20 has a cylindrical hollow shaft 22 which allows it to slide onto a drill bit or a screwdriver shaft 18 and then grip the bit or screwdriver shaft 18 tightly by the bit contact jaws 30 via the bit contact sleeve 26. Then, as shown in FIGS. 1-3, the shaft of a screw 10 will be held tightly at the distal end of the cylindrical shaft 22 by the screw contact jaws 40 via the screw contact sleeve 46, the chuck 44 (or screw contact chuck 44) and the like gearing.

FIGS. 1 and 2 show two chucks 24 and 44 held together by a single cylinder 32 and screws 50 and 52 that span both chucks 24 and 44. The cylinder 32 is common to conventional drill chucks and holds the chucks to the shaft of the drill bit or screwdriver 18 but does not rotate with the sleeves 26 and 46 when the sleeves are tightening or loosening the grip of the jaws 30 and 40 on the shaft 18 of the bit or screwdriver and on the screw 10, respectively. Instead, the sleeves 26 and 46 rotate relative to the cylinder 32 when gripping or releasing the shaft 18 of the bit or screwdriver and the screw 10. The cylinder 32 bounds a cavity 22 and can be comprised of metal, plastic or other material capable of attaching to each chuck 24 and 44 at each end of the cavity 22. The cylinder 32 is a type of elongated hollow element and may form a continuous circle or have a split instead. The elongated hollow element need not have a cylindrical shape, but rather could have any other geometric shape or combination of shapes. For example, the cross-section of the elongated hollow element could be either circular or polygonal or any combination thereof and could be split lengthwise.

Screw Contact Jaws and Screw Contact Sleeve

FIGS. 1, 2, 3 and 4A-C depict the screw contact chuck 44 and a set of respective jaws 40 that slide in grooved surfaces in the chuck 44. The jaws tips 42 of the screw contact jaws 40 are angled to hold the shaft of the screw 10 below its head 12 and below any angular portion thereof of the head 12. Therefore, as the pressure from the shaft 18 of the bit or screwdriver pushes the screw 10 into a surface 60, there will eventually be a force against the screw contact sleeve 46 from engagement of the underside of the screw contact sleeve 46 with the surface that is being penetrated by the turning of the screw 10. Such a force exerted against the underside of the screw contact sleeve 46 serves as a trigger that urges the jaws 40 of the screw contact sleeve 46 to move apart from each other at the jaws tip 42 as illustrated in the progressive views going from that of FIG. 4B to FIG. 4C.

Alternatively, the manner in which the jaws tip 42 move away from each other in response to the exertion of force on the underside of the jaws 40 may arise, for instance, if the construction of the jaws tips 42 is substantially incompressible and the jaws 40 are held either in a resilient manner against the screw stem or to have some give such that the jaws tip 42 follows the angled incline of the screw head to move apart from each other. Turning to FIGS. 4B and 4C, one may surmise that when pressure is exerted on the jaw tips 42 upon contact with the working surface that is being penetrated by the screw stem could urge the jaw tips 42 to move apart as they ride along the incline of the screw head (i.e., provided the screw contact sleeve 46 is configured or arranged so as to not prevent that from happening). That would be feasible if the jaw tips 42 are essentially incompressible (so they don't become wedged beneath the incline of the screw head under the pressure force) and if the jaws 40 are held in a manner that either provides them with some lateral give to accommodate being spread apart by the width of the screw head as the jaw tips 42 ride up or are resilient in the lateral direction to permit such spreading apart under force. Of course, there must be an outwardly diverging incline below the face of the screw head for this approach to be feasible.

As a further alternative, as shown in FIG. 3 and FIGS. 4A-C, the exertion of force on the underside of the jaws 40 will cause the notched chuck 44 to turn counterclockwise relative to the clockwise rotation of the bit and screwdriver 18, the notched chuck 24, the bit contact jaws 30 and the cylinder 32. Such would require "like gearing" (not shown, but the same as the gearing 28 but applied to the jaws 40) to reverse their rotation direction (from the rotation direction employed to grasp the stem of the screw) so as to separate the jaws 40 from the screw stem. Such is analogous to when the sleeve of any conventional chuck of a drill is turned counterclockwise, the grip on the drill bit or screwdriver releases. Here, the grip of the notched chuck 44 and screw contact jaws 40 begin to release as the screw contact sleeve 46 comes into contact with the surface 60 so that the screw contact sleeve 46 turns counterclockwise relative to the movement of the device 20. Since the screw contact sleeve 46 extends beyond the jaws 40, and contact the surface 60, friction will cause the sleeve 46 to stop turning clockwise with the rotation of the device 20 and screw 10; this results in a relative counter-clockwise rotation of the sleeve 46.

In an embodiment where the device 20 does not have the screw contact sleeve 46 extending beyond the screw contact jaws 40, so that the screw contact sleeve 46 does not come into contact with the surface 60 before the jaws 40, the screw 10 will be held in place by the screw contact jaws 40 until the jaws contact the surface 60. At that point, the user can manually turn the screw contact sleeve 46 counterclockwise to release the jaws 40 from the screw 10.

The device 20 is comprised of non-stretching and non-bending material, such as metal, that uses gears 28 and the like (for the screw contact chuck and sleeve) to position the jaws 30 and 40 and grab the bit 18 and screw 10, respectively. The gears 28 and the like are well established as means to tightly hold items without slipping or stretching such as gears associated with jaws to hold a drill bit. The problem with prior art products wherein pressure forces the screw 10 to be released from the hold of the device 20 is solved because the like gearing is such that the jaws 40 will hold the screw 10 and only release in accordance with the actual pressure applied by the surface 60 being screwed or drilled into. There is no such pressure until the screw 10 is completely into the surface 60 or, at least, well into the surface 60, which depends on how far down from the tip 12 of the screw 10, the user closes the screw contact jaws 40 and jaws tip 42.

For instance, U.S. Pat. No. 5,881,613, whose subject matter at col. 6 lines 38-67 is incorporated herein by reference, describes a screwdriver that provides an automatic disengagement mechanism to prevent excess penetration of the screw into a work surface.

In a preferred embodiment, as shown in FIGS. 2, 3, and 4A-C, the screw contact sleeve 46 extends beyond the screw contact jaws 40. In such an embodiment, as the screw 10 enters the surface 60, the screw contact sleeve 46 will contact the surface 60 before the screw contact jaws 40 contact the surface 60. At that point, due to friction from the surface 60, the screw contact sleeve 46 will not continue to turn clockwise with the 'screwing' or 'drilling' of the bit 18 driving the screw 10 into the surface 60. Upon the screw 10 being screwed into the surface 60, the friction applied by the surface 60 will be sufficient to relatively turn the screw contact sleeve 46 in a counterclockwise direction relative to the clockwise rotation of the rest of the device 20, the screw 10 and the bit or screwdriver 18. This will cause the screw contact chuck 44 and jaws 40 to open such that the screw contact jaws tip 42 will open and release the screw 10.

Prior art products are designed for low pressure, low torque screw holds. This device 20 is designed for any pressure including high pressure, high torque screw holds.

Conventional devices, such as that described by U.S. Pat. No. 6,857,343, are based on spring loading to hold the jaws around the screw. Like above, if the pressure required to keep the screwdriver tip in the screw head cavity is greater than the strength of the spring, then this product will fail. The spring will have a limited strength and, over time, like all mechanical springs, loses its strength as it is repetitively stretched and returned.

The invention is designed for high pressure and high torque screw holds. As shown in FIGS. 5 and 6, at the one end, the device 20 is affixed to a screwdriver shaft or a drill bit 18 via the bit contact jaws 30. As shown in FIGS. 3 and 4A-4C, the device 20 then holds the screw 10 with the screw contact jaws 40 and is designed for high pressure, high torque screw holds because of the like gearing. The screw contact jaws 40 automatically disengage when the screw contact sleeve 46 comes into contact with the surface 60, which is before the screw contact jaws tip 42 reaches the surface 60 into which the screw 10 has been driven into. The device 20 is not permanently affixed to any one screwdriver, but, via the bit contact jaws 30, may be affixed to any screwdriver or drill bit 18.

U.S. Pat. No. 7,779,734 is a screwdriver-starter. It initially holds a screw but, like the above described prior art, is meant to initially hold the screw and does not support high torque continuous holding of the screw. It uses a spring to push a screwdriver tip into the screw. Like the above prior art, it is not designed for high pressure, high torque screw holds and is not designed to automatically disengage once the screwdriver tip reaches the surface into which the screw is being driven.

Here, the inventor uses a set of screw contact jaws 40 whose tips 42 are extended inward toward the center so that, as the screw contact jaws 40 come together, the extension tips 42 grip the shaft of the screw 10, preferably just below the screw head 12. The screw contact jaws 40 hold the screw 10 in place throughout the process of drilling or turning the screw 10 into place. These jaws 40 automatically disengage once the jaws 40 or the screw contact sleeve 46 hits the surface 60 due to friction causing the screw contact sleeve 46 to stop its rotation in the clockwise direction, seemingly rotating in a counterclockwise direction relative to the rest of the device 20 that continues to rotate in the clockwise direction. This is because, when the screw contact sleeve 46 hits the surface 60, there is friction sufficient to stop the clockwise direction of the screw contact sleeve 46, which triggers its release of its engagement of the screw head 10 due to the like gearing driving in a counterclockwise direction relative to the clockwise rotation of the device 20. This action causes the contact chuck 44 and jaws 40 to open in accordance with the friction created by the force exerted on the surface 60.

As in a standard drill chuck, the screw contact sleeve 46 around the screw contact chuck and jaws 44 and 40, respectively, is turned to open or close the jaws 40 around the shaft of the screw 10. The like gearing for the notched chuck 44 and the screw contact jaws 40 are positioned such that closing the jaws 40 around the screw 10 requires the screw chuck sleeve 46 be turned in the same rotational direction of the screw 10 to be driven into the wall.

Again, it is noted that FIGS. 2-4 show the preferred embodiment of the invention described above. As stated, it is proposed to extend the rotating screw contact sleeve 46 to just beyond the edge of the jaw tips 42. When the screw contact sleeve 46 comes into contact with the surface 60, such as wood, as the screwdriver 18 and device 20 continues to turn, the friction between the surface 60 and the extended sleeve 46 causes the sleeve 46 to seemingly turn in the opposite direction releasing the jaws 40 from gripping the screw 10 thus disconnecting the notched chuck 44 from the screw 10. In this way, the screw contact jaws 40 release gradually as the contact and force/counter force from the surface increases.

Bit Contact Jaws and Bit Contact Sleeve

At the end of the screw bit holder chuck 24 into which one inserts a screw bit or screwdriver 18, a preferred embodiment comprises a set of jaws 30 similar to drill chucks so that as the jaws 30 come together, the jaws 30 grip the shaft of the screw bit or screwdriver 18. In this way, the device 20 can be slipped onto any drill bit or screwdriver because of the cylinder 32 and cavity 22. Then, at one end, the device 20 can be tightened onto the drill bit or shaft of the screwdriver 18 via the bit contact jaws 30. Turning the bit contact sleeve 26 allows the jaws 30 to tighten and grip the bit or shaft 18.

The positioning of the bit contact jaws 30 prior to the turning of the sleeve 26 is typically such that the distal end of the device having the screw contact jaws 40 and sleeve 46 will grip the shaft of a screw 10 just below the head 12 of the screw.

Variations of the dual sleeve jaw system can be created. For example, the bit contact jaws 30 and the bit contact sleeve 26 can be permanently assembled to a screwdriver. A drill assembly can have the dual sleeve jaw system as well. In any variation, the notched chuck 44 is provided to hold the screw 10 in the novel manner described herein.

While the foregoing description and drawings represent the preferred embodiments of the present invention, it will be understood that various changes and modifications may be made without departing from the scope of the present invention.

What is claimed is:

1. A device to grasp a screw stem and subsequently release same, comprising:

a shaft grasping assembly that is configured to move in and out of a grasping position at which the shaft grasping assembly is grasping a shaft of a bit or screwdriver, the shaft defining a rotational axis;

a screw stem grasping assembly that is configured to move in and out of a grasping position at which the screw stem grasping assembly is grasping the screw stem; and a hollow element separating the shaft grasping assembly from the screw stem grasping assembly, each of the shaft grasping assembly and the screw stem grasping assembly having a respective set of jaws, a respective drive mechanism and a respective sleeve having a concentric grooved surface about said rotational axis, arranged so that rotation of the respective sleeve in one direction causes the respective drive mechanism to move the respective jaws into a respective one of the grasping positions to effect the grasping accordingly and so that rotation of the respective sleeve in a reverse direction to that of the one direction moves the respective jaws out of the respective one of the grasping positions;

wherein each of the respective drive mechanisms includes a pair of respective notched chucks each having notches along which slide the respective ones of the respective jaws, the pair of respective grooved chucks being secured to the hollow element with respective fasteners, the respective fasteners each having a shaft extending along a direction parallel to said rotational axis that passes through respective openings of the respective sleeves.

2. The device of claim 1, wherein the respective jaws of the screw stem grasping assembly are configured and arranged to ride along an outwardly diverging incline of a head of the screw as the screw is driven into a working surface so that the head of the screw reaches the working surface.

3. The device of claim 1, wherein the respective jaws of the screw stem grasping assembly are configured and arranged to move into the respective grasping position by the respective driving means so that the respective jaws grasp a screw stem of a screw at a location that is beneath a head of the screw.

4. The device of claim 3, wherein a continuation of rotation of the screw after the release enables the head of the screw to penetrate into the working surface.

5. The device of claim 1, wherein each of the respective set of jaws includes three jaws that are spaced apart from each other and arranged to be moved by the respective drive mechanism.

6. The device of claim 1, wherein the respective chucks are positioned radially inside of associated ones of the respective sleeves so that as the respective jaws slide along the notches of the respective chucks, the respective jaws move radially with respect to the respective sleeves, the respective sleeves each having a cylindrical configuration.

7. A method to grasp a screw stem and subsequently release same, comprising:

providing a shaft grasping assembly that is configured to move in and out of a grasping position at which the shaft grasping assembly is grasping a shaft of a bit or screwdriver, the shaft defining a rotational axis and a screw stem grasping assembly that are separated from each other by a hollow element, each of the shaft grasping assembly and the screw stem grasping assembly having a respective set of jaws, a respective drive mechanism and a respective sleeve having a concentric grooved surface about said rotational axis, arranged so that rotation of the respective sleeve in one direction causes the respective drive mechanism to move the respective jaws into a respective grasping position and so that a rotation of the respective sleeve in a reverse direction to that of the one direction moves the respective jaws out of the respective grasping position, and effecting the rotation of the respective sleeve in the one direction and in the reverse direction to move the respective jaws in and out of the respective grasping position so that:

the shaft grasping assembly grasps a shaft of a bit or screwdriver via the respective jaws after reaching an associated one of the respective grasping positions; and the screw stem assembly grasps a stem of a screw via the respective jaws after reaching a further associated one of the respective grasping positions;

wherein each of the respective drive mechanisms includes a pair of respective notched chucks each having notches along which slide the respective ones of the respective jaws, the pair of respective notched chucks being secured to the hollow element with respective fasteners, the respective fasteners each having a shaft extending along a direction parallel to said rotational axis that passes through respective openings of the respective sleeves.

8. The method of claim 7, further comprising:

grasping a screw stem with the screw stem grasping assembly in the grasping position;

subjecting the respective sleeve of the screw stem grasping assembly to a force from a working surface that has been penetrated by the screw stem; and releasing the screw stem from the grasping by moving the respective jaws of the screw stem grasping assembly in the reverse direction by the respective drive mechanism of the screw stem grasping assembly as a result of the respective sleeve of the screw stem grasping assembly being subjected to the force from the working surface.

9. The method of claim 8, further comprising:

continuing with rotating the screw after the releasing so that the head of the screw penetrates into the working surface.

10. The method of claim 7, wherein each of the respective set of jaws includes three jaws that are spaced apart from each other and moved by the respective drive mechanism.

11. The method of claim 7, further comprising:

positioning the respective chucks radially inside of associated ones of the respective sleeves so that as the respective jaws slide along the notches of the respective chucks, the respective jaws move radially with respect to the respective sleeves, the respective sleeves each having a cylindrical configuration.

* * * * *